US008196655B2

(12) United States Patent
Kalman et al.

(10) Patent No.: US 8,196,655 B2
(45) Date of Patent: Jun. 12, 2012

(54) SELECTIVE PLACEMENT OF CONFORMANCE TREATMENTS IN MULTI-ZONE WELL COMPLETIONS

(75) Inventors: Mark D. Kalman, Luthersville, GA (US); Eldon D. Dalrymple, Pearland, TX (US); Larry Eoff, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 288 days.

(21) Appl. No.: 12/551,202

(22) Filed: Aug. 31, 2009

(65) Prior Publication Data

US 2011/0048707 A1 Mar. 3, 2011

(51) Int. Cl.
*E21B 43/12* (2006.01)
*E21B 43/14* (2006.01)

(52) U.S. Cl. ..... 166/250.01; 166/50; 166/305.1; 166/313; 166/369; 166/370; 166/386

(58) Field of Classification Search ..... None
See application file for complete search history.

(56) References Cited

U.S. PATENT DOCUMENTS 5,335,726 A 8/1994 Rodrigues
5,358,051 A 10/1994 Rodrigues
5,836,392 A 11/1998 Urlwin-Smith
5,840,784 A 11/1998 Funkhouser et al.
5,979,558 A 11/1999 Bouldin et al.
6,176,315 B1 1/2001 Reddy et al.
6,187,839 B1 2/2001 Eoff et al.
6,196,317 B1 3/2001 Hardy
6,364,016 B1 4/2002 Dalrymple et al.
6,476,169 B1 11/2002 Eoff et al.
6,585,051 B2 7/2003 Purkis et al.
6,607,035 B1 8/2003 Reddy et al.
6,764,981 B1 7/2004 Eoff et al.
6,838,417 B2 1/2005 Bouwmeester et al.
6,843,841 B2 1/2005 Reddy et al.
6,875,729 B2 4/2005 Verlaan et al.
6,889,768 B2 5/2005 Girgenti
6,981,552 B2 1/2006 Reddy et al.
7,013,980 B2 3/2006 Purkis et al.
7,091,160 B2 8/2006 Dao et al.
7,128,148 B2 10/2006 Eoff et al.
7,145,471 B2 12/2006 Purkis et al.
7,159,656 B2 1/2007 Eoff et al.
7,267,174 B2 9/2007 Gonsveld et al.
(Continued)

OTHER PUBLICATIONS

Extending the Productive Life of Mature Assets, Supplement to E&P, 2007, pp. 1-48, Hart Energy Publishing, LP, Houston, Texas.

(Continued)

*Primary Examiner* — George Suchfield
(74) *Attorney, Agent, or Firm* — Marlin R. Smith

(57) ABSTRACT

Selective placement of conformance treatments in multi-zone well completions. A method includes injecting a relative permeability modifier into a zone and optimizing a ratio of desired fluid to undesired fluid produced from the zone, including adjusting at least one flow control device between fully open and fully closed configurations. Another method includes injecting a relative permeability modifier into multiple zones, one at a time, via respective flow control devices, and then producing fluid from each of the zones. Another method includes identifying which of the zones to treat by, for each of the zones: a) closing flow control devices corresponding to the other zones, and b) evaluating fluid produced from the zone; and injecting a conformance treatment into the zones identified as the zones to treat.

8 Claims, 5 Drawing Sheets

U.S. PATENT DOCUMENTS

| | | | | |
|---|---|---|---|---|
| 7,287,587 | B2 | 10/2007 | Reddy et al. | |
| 7,322,414 | B2 | 1/2008 | Reddy et al. | |
| 7,325,613 | B2 | 2/2008 | Reddy et al. | |
| 7,331,390 | B2 | 2/2008 | Eoff et al. | |
| 7,451,814 | B2 | 11/2008 | Graham et al. | |
| 7,478,676 | B2 | 1/2009 | East, Jr. et al. | |
| 7,563,750 | B2 | 7/2009 | Eoff et al. | |
| 2004/0229757 | A1 | 11/2004 | Eoff et al. | |
| 2005/0164894 | A1 | 7/2005 | Eoff et al. | |
| 2005/0178549 | A1* | 8/2005 | Eoff et al. | 166/295 |
| 2006/0185848 | A1* | 8/2006 | Surjaatmadja et al. | 166/280.2 |
| 2007/0012444 | A1 | 1/2007 | Horgan et al. | |
| 2007/0114032 | A1* | 5/2007 | Stegent et al. | 166/287 |
| 2007/0284106 | A1* | 12/2007 | Kalman et al. | 166/298 |
| 2009/0095484 | A1* | 4/2009 | Huang et al. | 166/319 |
| 2011/0036578 | A1* | 2/2011 | Coronado | 166/305.1 |

OTHER PUBLICATIONS

WellDynamics Interval Control Valves product brochure, Sep. 11, 2008, 4 pages.

Halliburton WaterWeb Service product brochure H03706, May 2008, 2 pages.

Halliburton CW-Frac Service product brochure H03897, May 2008, 2 pages.

Halliburton LO-Gard Service product brochure H05500, Sep. 2007, 2 pages.

Dalrymple, D., Gutierrez, M., Vasquez, J., and Eoff, L., Results of Advanced Technology Utilization in Selective Water Reduction, ACIPET XII Congreso Colombiano del Petroleo, Bogota D.C., Colombia, Oct. 23-26, 2007, 5 pages.

Halliburton H2Zero™ Service product brochure H00216R, Apr. 2008, 2 pages.

Warren, John, What's New in Water Management?, E&P Jul. 2004, Hart Energy Publishing, Houston, Texas, 2 pages.

Denney, Dennis, Technology Applications, JPT, Feb. 2008, pp. 24-27.

Halliburton Delta Stim® Sleeve product brochure H04616, Sep. 2008, 4 pages.

2004 Meritorious Awards for Engineering Innovation, Hart's E&P Apr. 2004, pp. 89-99.

International Search Report and Written Opinion issued Apr. 18, 2011, for PCT Patent Application No. PCT/U52010/046406, 8 pages.

Examination Report issued Mar. 22, 2012 for Australian Patent Application No. 2010286756, 2 pages.

* cited by examiner

SELECTIVE PLACEMENT OF CONFORMANCE TREATMENTS IN MULTI-ZONE WELL COMPLETIONS

BACKGROUND

This disclosure relates generally to operations performed and equipment utilized in conjunction with a subterranean well and, in an example described below, more particularly provides for selective placement of conformance treatments in multi-zone well completions.

It is generally desirable to maximize production of hydrocarbons from a subterranean formation, while minimizing production of undesired fluid (such as water or, in some situations, gas). In the past, chemical and mechanical conformance treatments have been used independently to reduce or prevent production of undesired fluids.

Chemical conformance treatments generally consist of treating wells with either sealants or relative permeability modifiers. Unfortunately, where multiple zones are to be treated, the chemical conformance treatments have typically been "bullheaded" into the zones. This can lead to waste of the conformance treatment, ineffective treatment of some zones (e.g., the zones into which the conformance treatment does not preferentially flow), and other problems.

Mechanical conformance generally consists of closing or restricting flow from the reservoir to the wellbore at one or more zones via a flow control device located in a wellbore completion assembly. Unfortunately, mechanical conformance can result in valuable hydrocarbons left in the reservoir.

Thus, it may be seen that improvements are needed in the art of treating zones in a well and producing from treated zones, so as to maximize production of valuable hydrocarbons from the reservoir over the life of the well, while minimizing production of undesirable fluids such as water or gas.

SUMMARY

In the disclosure below, methods are provided which bring improvements to the art of treating zones in wells. One example is described below in which a relative permeability modifier is injected into a zone, and then fluid production from the zone is optimized. Another example is described below in which a conformance treatment is selectively injected into zones which are identified for treatment.

In one aspect, this disclosure provides to the art a method of treating and producing at least one zone intersected by a wellbore. The method includes the steps of: injecting a relative permeability modifier into at least a portion of the zone; and optimizing a ratio of desired fluid to undesired fluid produced from the zone. The optimizing step includes adjusting at least one flow control device between fully open and fully closed configurations.

In another aspect, a method of selectively treating and producing multiple zones intersected by a wellbore is provided. The method includes the steps of: injecting a relative permeability modifier into the zones, one at a time, via respective flow control devices; and then producing fluid from each of the zones.

In yet another aspect, a method of selectively treating and producing multiple zones intersected by a wellbore is provided which includes the steps of: identifying which of the zones to treat by, for each of the multiple zones: a) closing flow control devices corresponding to all of the other zones, and b) evaluating fluid produced from the zone; and injecting a chemical conformance treatment into the zones identified as the zones to treat in the identifying step. An additional step may include evaluating fluid produced from the zone again after injection of the chemical conformance treatment to verify the effectiveness of the treatment.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
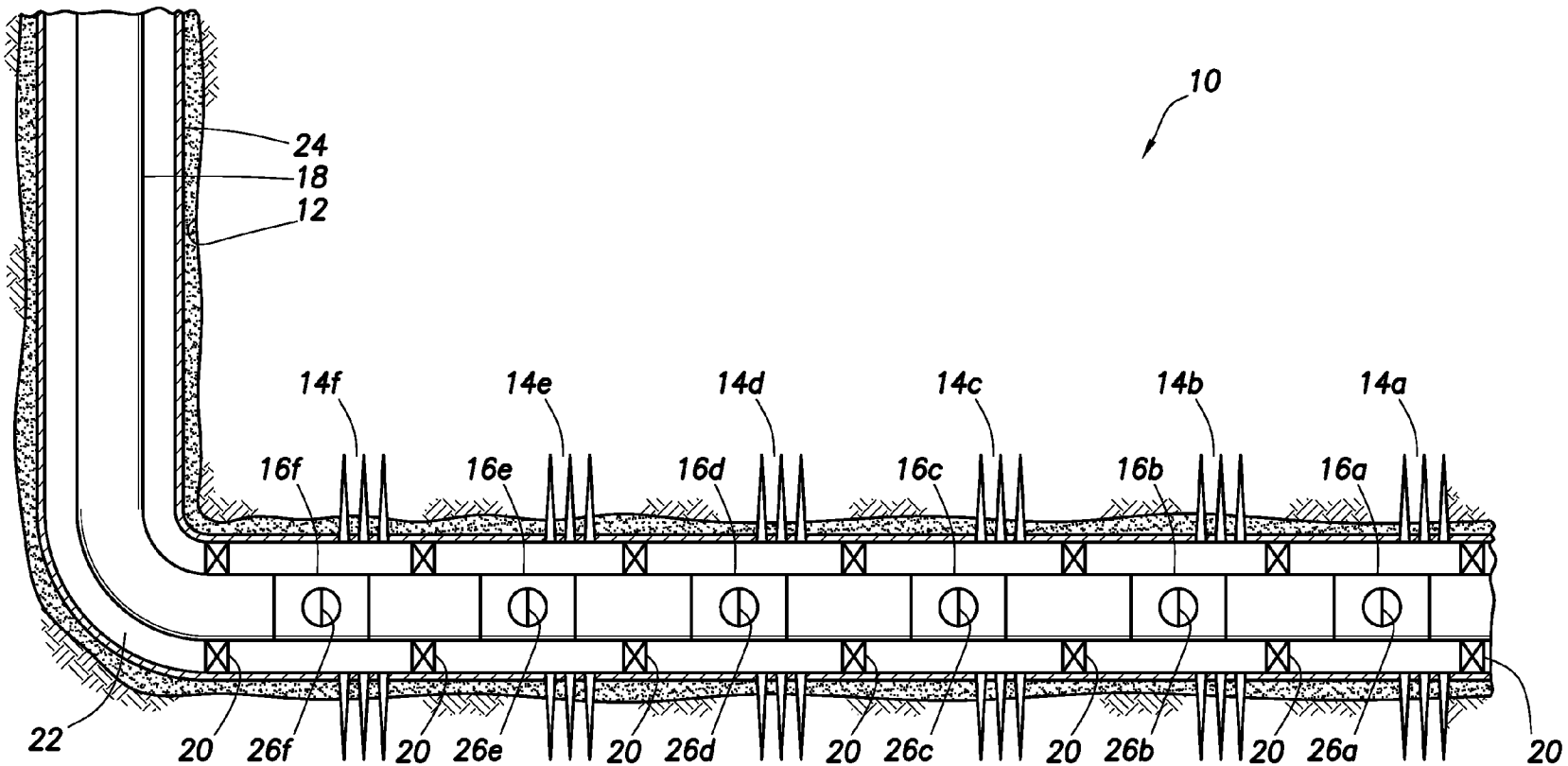
FIG. 1 is a schematic partially cross-sectional view of a well system embodying principles of the present disclosure.

Representatively illustrated in FIG. 1 is a well system 10 which embodies principles of this disclosure. In the system 10, a wellbore 12 intersects multiple zones 14 (designated in FIG. 1 as zones 14*a-f*). Fluid is produced from the zones 14 via respective multiple flow control devices 16 (designated in FIG. 1 as devices 16*a-f*) interconnected in a tubular string 18.

The zones 14 are isolated from each other in the wellbore 12 by packers 20. As depicted in FIG. 1, the packers 20 seal off an annulus 22 formed between the tubular string 18 and casing 24 which lines the wellbore 12. However, if the portion of the wellbore 12 which intersects the zones 14 were uncased or open hole, then the packers 20 could seal between the tubular string 18 and a wall of the wellbore.

Although the portion of the wellbore 12 which intersects the zones 14 is depicted in FIG. 1 as being substantially horizontal, it should be clearly understood that this orientation of the wellbore is not essential to the principles of this disclosure. The portion of the wellbore 12 which intersects the zones 14 could be otherwise oriented (such as, vertical, inclined, etc.).

Indeed, the principles of this disclosure are not to be taken as being limited at all by the details of the system 10 depicted in FIG. 1, and as described herein. Instead, the system 10 is given as merely one example of a wide variety of well systems which can benefit from the advancements in the art provided by this disclosure.

Each of the flow control devices 16 includes a flow regulating member 26 (designated in FIG. 1 as members 26*a-f*) for regulating a rate of flow of fluid into the flow control device. The members 26 may also be used to fully close off or fully open the flow control devices 16 to flow, but preferably the members are used at least to adjust the flow through the flow control devices between their fully closed and fully open configurations.

In this manner, the flow control devices 16 may be of the type designated as "chokes" rather than "valves." However, the flow control devices 16 can also serve as valves (i.e., to fully close off or fully open flow between the zones 14 and the tubular string 18).

Suitable flow control devices are available from WellDynamics, Inc. of Spring, Tex. USA and Halliburton Energy Services, Inc. of Houston, Tex. USA for use as the flow control devices 16, although other flow control devices may be used if desired. In particular, WellDynamics markets its HV Series Interval Control Valve flow control devices, which are accurately and remotely controllable from the surface. The HV Series Interval Control Valve flow control devices have both flow choking and valve capabilities. The position of the flow control device can be controlled hydraulically or electrically, such as through hydraulic or electric control lines from the surface, wirelessly by telemetric signals from the surface, manually through shifting tools deployed on slickline, wireline, coiled tubing or jointed pipe workstring, by ball or dart drop, or by any other means known in the art.

In the system 10 and associated methods, it is beneficial to enhance production of desired fluids (e.g., hydrocarbon fluids, including hydrocarbons in the gas and/or condensate phase, as well as the liquid phase) from the zones 14, and to reduce production of undesired fluids (e.g., water and/or, in some cases, gas). In one method described below, a ratio of desired fluid to undesired fluid produced from one or more zones 14 is optimized, for example, by maximizing production of the desired fluid and/or minimizing production of the undesired fluid. In another method described below, appropriate ones of the zones 14 to be treated are identified by selectively opening and closing the flow control devices 16, and evaluating flow of fluids from each of the zones 14 individually.

One or more of the zones 14 which are identified for treatment are injected with a conformance treatment. As used herein, the term "conformance treatment" is used to indicate a treatment which restricts flow of undesired fluid into a wellbore.

Two broad categories of conformance treatments are typically used. One of these is sealants, which close off the pores of a formation to all fluid flow therethrough. Sealants may be used to prevent water or gas encroachment to a wellbore, to prevent migration of water or gas between zones, etc.

A suitable sealant for use in the system 10 and associated methods described herein is an H2ZERO™ sealant marketed by Halliburton Energy Services, Inc. However, other sealants may be used in keeping with the principles of this disclosure.

Another category of conformance treatment is relative permeability modifiers, which change the effective relative permeability of the formation structure to water. A ratio of permeability of the formation structure to undesired fluid, to permeability of the formation structure to desired fluid, is decreased by a relative permeability modifier. This decrease may be due to a reduced permeability of the formation structure to undesired fluid and/or may be due to an increased permeability of the formation structure to desired fluid.

A suitable relative permeability modifier for use in the system 10 and associated methods described herein is an HPT-1™ permeability modifier marketed by Halliburton Energy Services, Inc. However, other relative permeability modifiers may be used in keeping with the principles of this disclosure.

Figure 2:
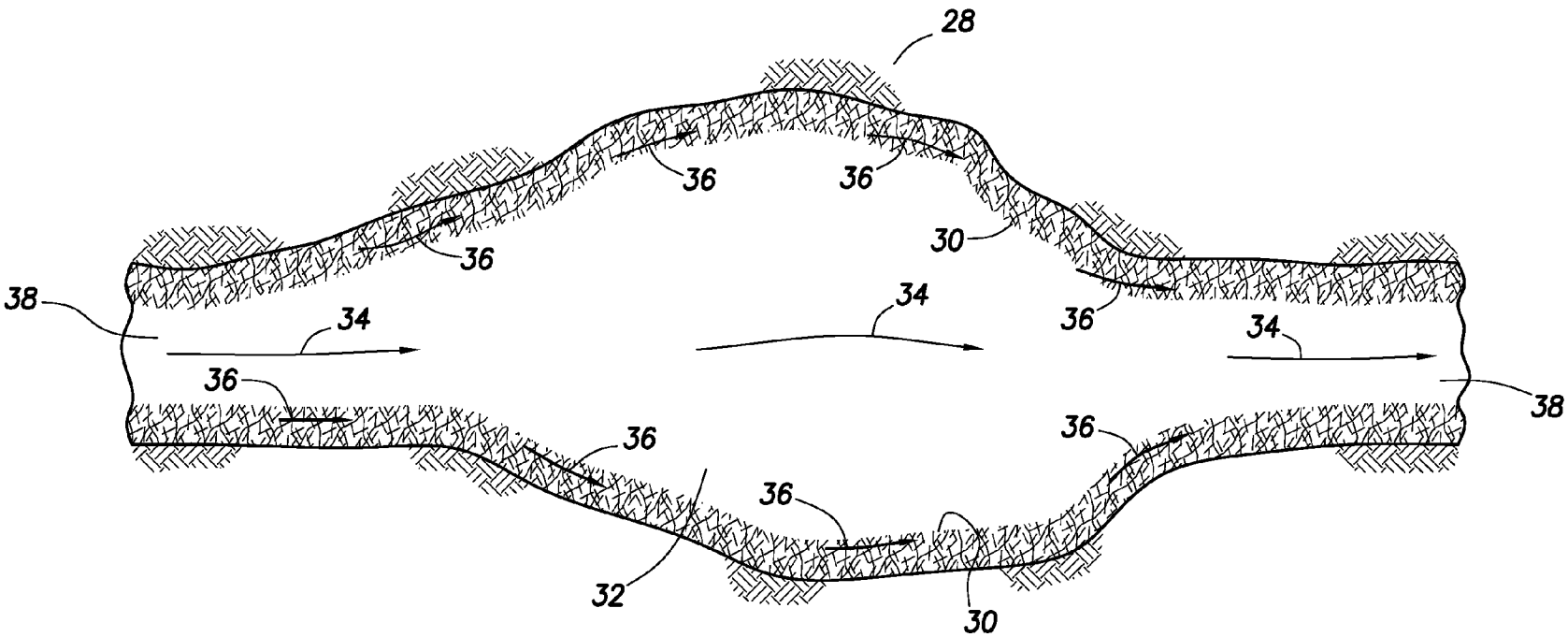
FIG. 2 is an enlarged scale cross-sectional view of a formation pore flowpath after treatment in the well system of FIG. 1.

Referring additionally now to FIG. 2, a very large scale cross-sectional view of a pore throat in an example formation structure 28 after having been treated with a relative permeability modifier 30 is representatively illustrated. In particular, a pore 32 in the formation structure 28 is depicted in FIG. 2, with both desired fluid 34 and undesired fluid 36 flowing through the pore via interconnecting passages 38. In effect, the undesired fluid 36 and the desired fluid 34 can be moving through the same pore throat, but through separate and distinct flow paths.

After treatment, the walls of the pore 32 have the relative permeability modifier 30 adsorbed onto them. Although not readily apparent from the illustration in FIG. 2, the relative permeability modifier 30 preferably has a somewhat "open matrix" structure which causes resistance to flow of the undesired fluid 36 moving through it.

If the undesired fluid 36 is water, for example, the attachment of a relative permeability modifier 30 treatment on the walls of the pore 32 may impede the flow of water by the "open matrix" of the relative permeability modifier 30 on the pore throat walls. Thus, the formation structure 28 becomes less permeable to the flow of the undesired fluid 36. The relative permeability modifier 30 is not functioning as a porosity fill sealant. Fluid can still flow through the treated pore 32, but the undesired fluid flow will be restricted via the "open matrix". The desired fluid phase will experience little or no significant impediment by the "open matrix." It is important to note that the dimensions of the porous "open matrix" formed by the relative permeability modifier 30 within the pore throat 32 will instead be a function of the differential pressure across that pore throat 32.

The ratio of permeabilities of the formation structure 28 to desired and undesired fluids 34, 36 can change depending, for example, on a pressure differential across the formation structure, a rate of flow of the fluids through the formation structure, etc. Thus, it is possible to optimize the ratio of permeabilities by, for example, maximizing the permeability of the formation structure 28 to the desired fluid 34 and/or minimizing the permeability of the formation structure to the undesired fluid 36.

Figure 3:
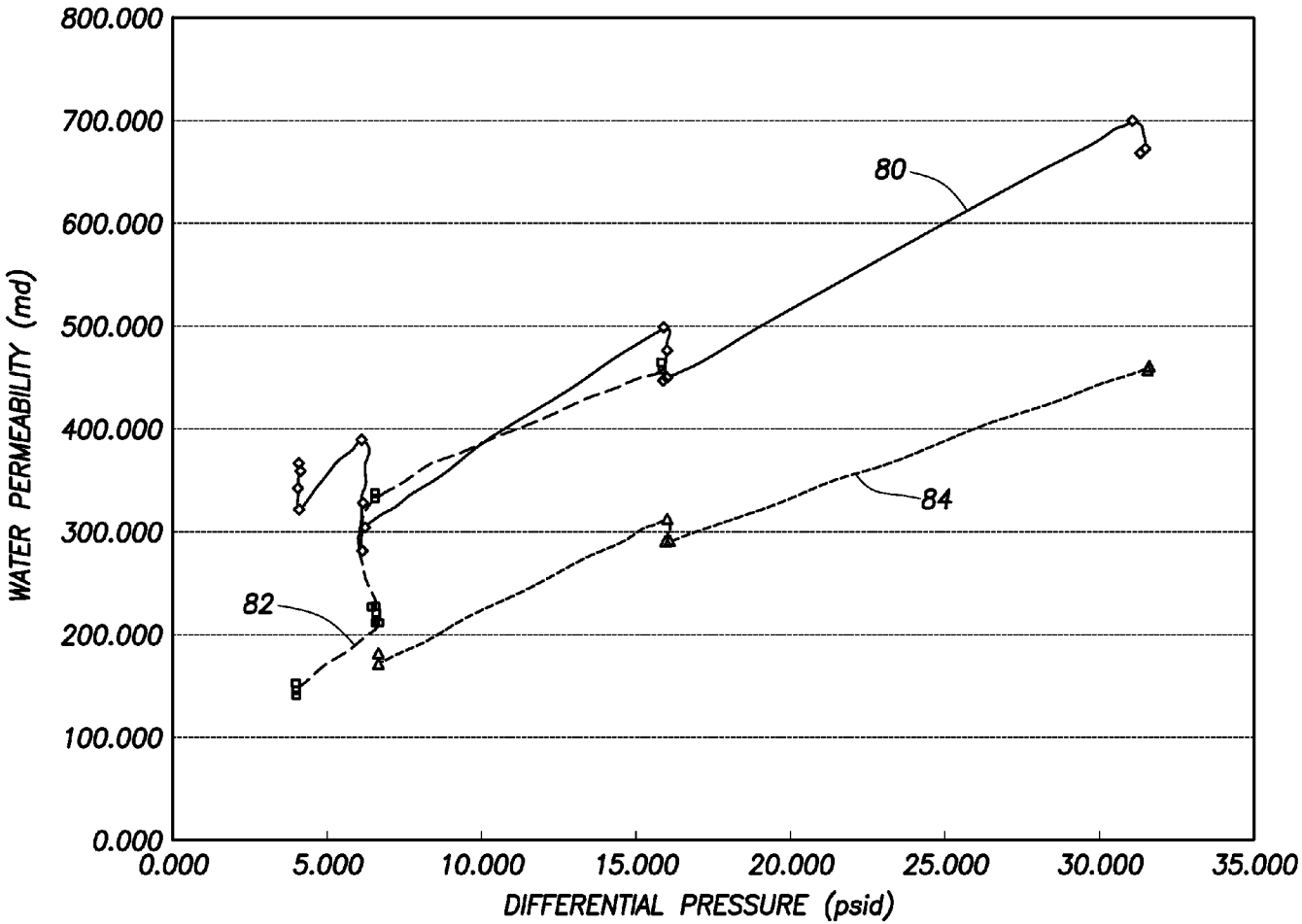
FIG. 3 is a representative graph of relative permeability versus differential pressure for a formation after treatment in the well system of FIG. 1.

Referring additionally now to FIG. 3, a representative graph of effective permeability for a range of differential pressures is representatively illustrated. Three curves 80, 82, 84 are shown on the graph, each of which corresponds to a period after treatment of a formation structure (such as the structure 28) with a relative permeability modifier (such as the relative permeability modifier 30).

In this example, a sandstone core with an initial permeability of 585 and (577 $\mu m^2$) at a differential pressure of ~5 psi (0.345 bar) was treated with a relative permeability modifier. Following the treatment, the core's effective water permeability at the same differential pressure was ~325 and (321 $\mu m^2$) as indicated by curve 80 in FIG. 3.

It can be confirmed by one skilled in the art that, according to Darcy's law, during flow through porous media, flow rate is directly proportional to the differential pressure. For linear flow, for example:

$$K=QuL/(\Delta PA) \quad (1)$$

in which K is permeability in darcies, Q is flow rate in cc/sec, L is length in cm, u is viscosity in cp, ΔP is differential pressure in atmospheres, and A is cross sectional area in $cm^2$.

Stated another way, the flow rate will change sufficiently with variations in differential pressure that the value for permeability will remain essentially constant.

For a core treated with a relative permeability modifier, the proportionality between differential pressure and flow rate holds true for the hydrocarbon flow, but as can be observed in FIG. 3, it does not hold true for the flow of water through a formation structure treated with a relative permeability modifier.

Thus, the effective permeability to oil will typically be the same before and after a relative permeability modifier treatment, however the effective permeability to water is typically reduced when the permeability values to water before and after treatment are compared at the same differential pressure.

Following treatment with a relative permeability modifier, the flow rate of water through the structure is no longer directly proportional to the differential pressure. As the differential pressure is increased, the reduction in the effective permeability to water begins to diminish.

The significance of the change is a function of the pore throat size, indirectly associated with permeability. That is, the higher the permeability, the larger the pore throat size. The higher the permeability (i.e., pore throat size), the greater the slope observed in the degree of reduced effective water permeability, which would asymptotically approach the untreated value.

FIG. 3 indicates that an increase in the effectiveness of relative permeability treatments can be obtained by reducing the drawdown differential pressure. The effect would be a reduction in the effective water permeability, with little to no change in the effective oil permeability (thereby resulting in a larger ratio of desired to undesired fluids produced). An economic analysis could be performed to optimize the amount of oil produced at a given drawdown differential pressure while minimizing the amount of accompanying water produced.

In the example shown in FIG. 3, it can be seen that by increasing the differential pressure, the effective permeability to water increases. The hysteresis study represented by FIG. 3 shows that by decreasing the pressure, the effective permeability decreases.

Figure 4:
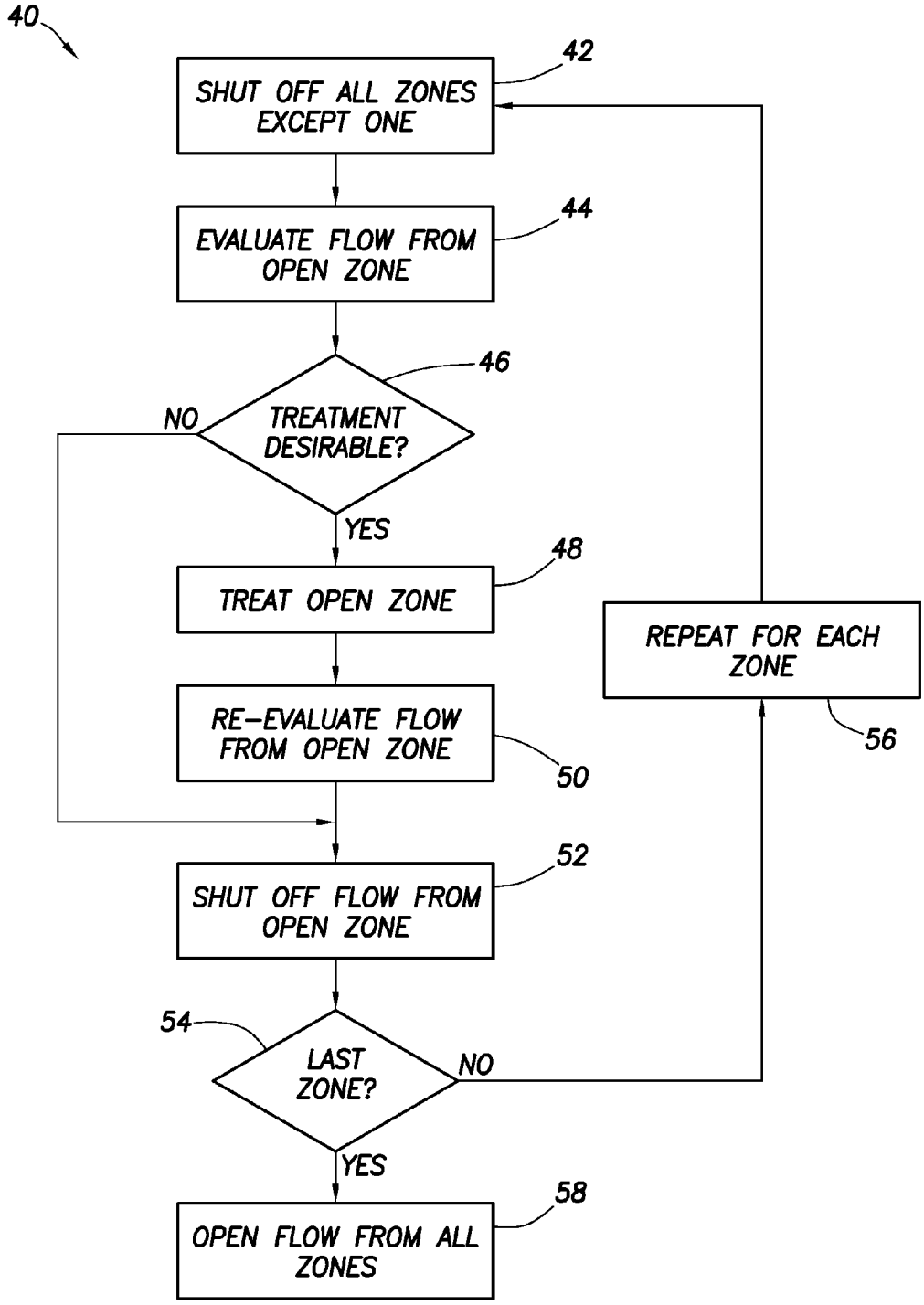
FIG. 4 is a flowchart for a method of identifying and treating zones in the system.

Referring additionally now to FIG. 4, a method 40 of selectively treating and producing the zones 14 is representatively illustrated in flowchart form. The method 40 includes an evaluation process for determining whether each zone 14 should be treated, and if treated, an evaluation of the effectiveness of the treatment of each zone. In this example, a relative permeability modifier treatment is to be used, but other types of conformance treatments may be used in other examples.

In an initial step 42 of the method 40, all of the zones 14 are shut off, except for one. For example, to begin with the zone 14*a*, all of the flow control devices 16*b-f* would be closed, so that only fluid from the zone 14*a* is produced into the tubular string 18.

Of course, the process could begin with any of the zones 14*a-f*, and could proceed from one to the next in any order. This description of the method 40 will assume that zone 14*a* is evaluated for treatment first, but the process could instead begin with zone 14*f*, or zone 14*d*, etc., in other examples.

In step 44, flow from the open zone 14*a* is evaluated. This evaluation can include any number of measurements, such as, water cut, gas cut, permeability, fluid typing, etc.

In step 46, a decision is made as to whether treatment of the open zone 14*a* is desirable. The zone 14*a* could be producing an acceptably high ratio of desired to undesired fluids, for example, in which case it may not be useful or economically reasonable to treat the zone. In that case, the method 40 proceeds to step 52 described more fully below.

If treatment of the open zone 14*a* is desirable (for example, if the zone is producing an unacceptably high ratio of undesired to desired fluids, etc.), then the method 40 proceeds to step 48, in which the open zone is treated.

In step 48, the relative permeability modifier 30 treatment is injected into the open zone 14*a* via the open flow control device 16*a*. The relative permeability modifier 30 enters the formation structure 28 and makes the formation structure less permeable to the undesired fluid 36 and/or more permeable to the desired fluid 34.

When the treatment step 48 is completed, flow from the open zone 14*a* is again evaluated in step 50. The effectiveness of the treatment is determined in this step 50. It may be determined that re-treatment would be beneficial, that flow from the zone 14*a* should be permanently closed off, or that the treatment has been suitably effective, etc.

In step 52, the open zone 14*a* is closed off, for example, by closing the flow control device 16*a*. In step 54, if there are more zones (e.g., zones 14*b-f*) to evaluate for treatment, then steps 42-54 are repeated for each subsequent zone, as indicated by step 56.

When the last zone has been evaluated, then the method 40 proceeds to step 58, in which all of the zones 14*a-f* are opened for production of fluids into the tubular string 18, for example, by opening all of the flow control devices 16*a-f*. Of course, if it was determined in step 50 that production from one or more of the zones 14*a-f* should be permanently ceased, then those zones should not be opened in step 58.

Figure 5:
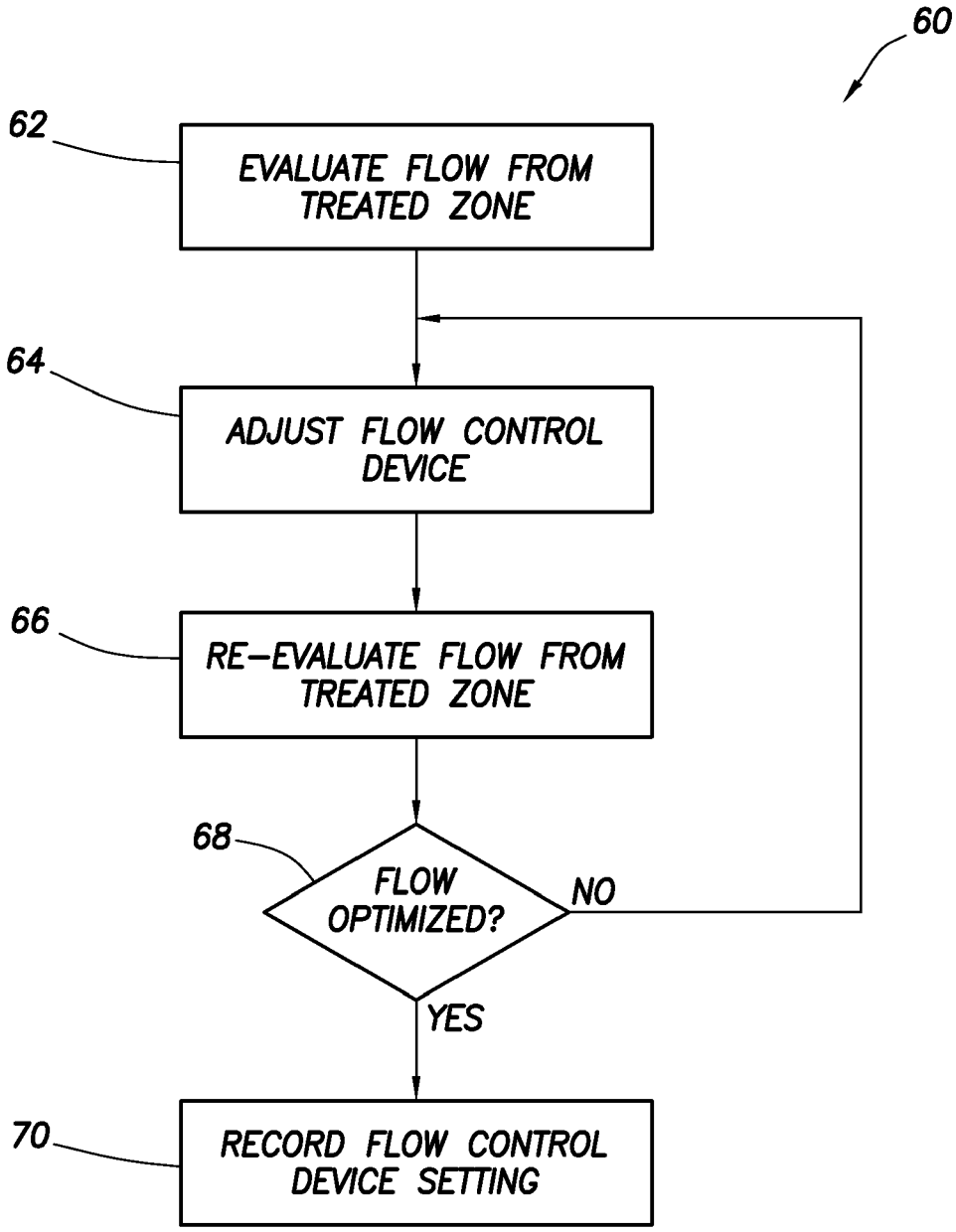
FIG. 5 is a flowchart for a method of optimizing flow from a treated zone.

As discussed above, it is possible to optimize flow from each of the zones 14 which has been treated with the relative permeability modifier 30. In FIG. 5, a method 60 of doing so is representatively illustrated in flowchart form.

The method 60 may be performed during the method 40 described above, or it may be performed after the relative permeability modifier treatment process has been completed for all of the zones to be treated. If performed in conjunction with the method 40, then the initial step 62 in the method 60 may correspond to step 50 in the method 40. In that case, steps 62-70 of the method 60 would be substituted for step 50 in the method 40.

In the description below, the method 60 is described in the example where the zone 14*a* is treated with the relative permeability modifier 30 (e.g., using the method 40), and then production from the zone is optimized. However, the method 60 could, in other examples, be performed for any of the other zones 14*b-f*, or in any other well system or method in which a zone has been treated with a relative permeability modifier.

In step 62, flow from the treated zone 14*a* is evaluated. This is similar to the steps 44, 50 in the method 40, as described above. This results in a certain flow rate of the fluids into the tubular string 18, with a corresponding pressure differential being applied across the treated portion of the zone 14*a*. Preferably, flow from all of the other zones 14*b-f* is closed off during this step 64, as provided for in step 42 of the method 40.

In step 64, the flow control device 16*a* is adjusted to permit flow of fluids from the zone 14*a* into the tubular string 18 via the flow control device. This results in another flow rate of the fluids into the tubular string 18, with another certain pressure differential being applied across the treated portion of the zone 14*a*.

In step 66, the flow from the treated zone 14*a* is evaluated again. The ratio of undesired and desired fluids 36, 34 produced from the zone 14*a* will be different, due to the different flow rates of the fluids and the different pressure differentials applied across the treated portion of the zone 14*a*.

A linear relationship does not necessarily exist between the configuration of the flow control device 16*a*, the flow rate of fluids produced from the zone 14*a*, the pressure differential applied across the treated portion of the zone, and the ratio of desired and undesired fluids 34, 36 produced from the zone. Thus, it will typically be desirable to repeatedly adjust the flow control device 16*a* to various configurations between its fully open and fully closed configurations (e.g., by varying the position of the flow regulating member 26*a* between its fully open and fully closed positions), until the optimum configuration of the flow control device is determined.

This is schematically represented by step 68 in the method 60, in which a determination is made as to whether the flow through the flow control device 16*a* has been optimized. If the optimum configuration of the flow control device 16*a* has not yet been determined, then steps 64, 66 are repeated with the flow control device 16*a* adjusted to another configuration.

When it has been determined that flow through the flow control device 16*a* has been optimized, the method 60 proceeds to step 70, in which the configuration of the flow control device is recorded for future reference. For example, in the method 40, the flow control device 14*a* may be subsequently closed while another of the zones 14*b-f* is evaluated and treated, and the flow from the zone is optimized, etc. Once the methods 40, 60 have been performed for all of the zones 14*a-f* individually, then the flow control devices 16*a-f* can all be returned to their individual optimized configurations, resulting in optimized flow of fluids from all of the zones.

In addition, the operator must consider that the flowrates of desirable and undesirable fluids from a zone which has been treated and for which a flow control device position has been set may change as a result of changes in the differential pressure between the reservoir and the wellbore. The differential pressure may change as a result of opening or shutting off flow from one or more of the zones 14*a-f*. The differential pressure may also change over time as the reservoir is depleted. Therefore, it may be desirable to adjust the position of the flow control device from a previously optimized setting by conducting periodic flow modeling, in combination with measurements of the quantities of undesirable and desirable fluid flow, and re-optimize the flow control device positions to maximize the flow of desirable fluids while minimizing the flow of undesirable fluids.

It may now be appreciated that this disclosure provides many advancements to the art of treating zones in wells. Individual zones can be treated selectively with conformance treatments. Flow from a zone can be optimized after the zone has been treated with a relative permeability modifier.

The above disclosure in particular provides to the art a method of treating and producing at least one zone 14 intersected by a wellbore 12. The method includes the steps of: injecting a relative permeability modifier 30 into at least a portion of the zone 14; and optimizing a ratio of desired fluid 34 to undesired fluid 36 produced from the zone 14. The optimizing step includes adjusting at least one flow control device 16 between fully open and fully closed configurations.

The optimizing step may also include adjusting the flow control device 16 to a configuration in which the ratio of desired fluid 34 to undesired fluid 36 produced from the zone 14 is maximized.

The optimizing step may include adjusting the flow control device 16 to permit a non-zero flow rate through the flow control device 16, at which flow rate the ratio of desired fluid 34 to undesired fluid 36 produced from the zone 14 is maximized.

The optimizing step may include adjusting the flow control device 16 to produce a pressure differential across the portion of the zone 14, at which pressure differential the ratio of desired fluid 34 to undesired fluid 36 produced from the zone 14 is maximized.

The optimizing step may include adjusting the flow control device 16 to multiple configurations between the fully open and fully closed configurations, measuring the ratio of desired fluid 34 to undesired fluid 36 produced from the zone 14 at each of the multiple configurations between the fully open and fully closed configurations, and adjusting the flow control device 16 to the one of the configurations which corresponds to an optimal one of the ratios of desired fluid 34 to undesired fluid 36 produced from the zone 14. The optimal one of the ratios may be a maximum one of the ratios.

The wellbore 12 may intersect multiple zones 14*a-f*, and the injecting step may include injecting the relative permeability modifier 30 into the zones 14*a-f*, one at a time, via multiple respective flow control devices 16*a-f*. The method may include producing fluid from each of the zones 14*a-f*.

The above disclosure also provides to the art a method of selectively treating and producing multiple zones 14*a-f* intersected by a wellbore 12, with the method including the steps of: injecting a relative permeability modifier 30 into the zones 14*a-f*, one at a time, via respective flow control devices 16*a-f*; and then producing fluid from each of the zones 14*a-f*.

The producing step may include producing fluid via the flow control devices 16*a-f*.

The method may also include the step of optimizing a ratio of desired fluid 34 to undesired fluid 36 produced from each of the zones 14*a-f*, with the optimizing step including adjusting the respective flow control device 16*a-f* between fully open and fully closed configurations.

The method may include the step of selecting one of the zones 14*a-f* for injection of the relative permeability modifier 30 therein by opening the respective one of the flow control devices 16*a-f*.

The method may include the step of identifying the zones 14*a-f* to be treated by, for each of the zones 14*a-f*: a) closing the flow control devices 16*a-f* corresponding to all of the other zones 14*a-f*, and *b*) evaluating the fluid produced from the zone.

The above disclosure also provides to the art a method of selectively treating and producing multiple zones 14*a-f* intersected by a wellbore 12, with the method including the steps of: identifying which of the zones 14*a-f* to treat by, for each of the multiple zones 14*a-f*: a) closing flow control devices 16*a-f* corresponding to all of the other zones 14*a-f*, and *b*) evaluating fluid produced from the zone; and injecting a conformance treatment into the zones 14*a-f* identified as the zones to treat in the identifying step.

The conformance treatment may comprise a relative permeability modifier 30. The method may include producing fluid from the each of the zones 14*a-f* into which the relative permeability modifier 30 is injected.

The method may include the step of, after the injecting step, opening multiple ones of the flow control devices 14*a-f* corresponding to multiple ones of the zones 16*a-f*.

The fluid may be produced through a flow control device 16*a-f* corresponding to the zone 14*a-f* in the evaluating step. The conformance treatment may be injected via the corresponding flow control device 16*a-f* into each of the zones 14*a-f* identified as the zones to treat in the identifying step.

The method may include the step of, after the injecting step, optimizing a ratio of desired fluid 34 to undesired fluid 36 produced from each of the zones 14*a-f* identified as the zones to treat in the identifying step. The optimizing step may include adjusting the corresponding flow control device 16*a-f* between fully open and fully closed configurations.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of treating and producing fluids from at least one zone intersected by a wellbore, the method comprising the steps of:

injecting a relative permeability modifier into at least a portion of the zone; and optimizing a ratio of desired fluid to undesired fluid produced from the zone, the optimizing step including adjusting at least one flow control device between fully open and fully closed configurations.

2. The method of claim 1, wherein the optimizing step further comprises adjusting the flow control device to a configuration in which the ratio of desired fluid to undesired fluid produced from the zone is maximized.

3. The method of claim 1, wherein the optimizing step further comprises adjusting the flow control device to permit a non-zero flow rate through the flow control device, at which flow rate the ratio of desired fluid to undesired fluid produced from the zone is maximized.

4. The method of claim 1, wherein the optimizing step further comprises adjusting the flow control device to produce a pressure differential across the portion of the zone, at which pressure differential the ratio of desired fluid to undesired fluid produced from the zone is maximized.

5. The method of claim 1, wherein the optimizing step further comprises adjusting the flow control device to multiple configurations between the fully open and fully closed configurations, measuring the ratio of desired fluid to undesired fluid produced from the zone at each of the multiple configurations between the fully open and fully closed configurations, and adjusting the flow control device to the one of the configurations which corresponds to an optimal one of the ratios of desired fluid to undesired fluid produced from the zone.

6. The method of claim 5, wherein the optimal one of the ratios is a maximum one of the ratios.

7. The method of claim 1, wherein the wellbore intersects multiple zones, wherein the injecting step further comprises injecting the relative permeability modifier into the zones to be treated, via multiple respective flow control devices, and further comprising the step of producing fluid from each of the zones.

8. The method of claim 7, wherein the relative permeability modifier is injected into the zones to be treated one at a time.

* * * * *